United States Patent [19]

Ihama et al.

[11] Patent Number: 4,977,075

[45] Date of Patent: Dec. 11, 1990

[54] SILVER HALIDE PHOTOGRAPHIC EMULSION

[75] Inventors: Mikio Ihama; Yuji Kume; Koji Tamoto; Hiroshi Takehara; Masao Arai, all of Kanagawa, Japan

[73] Assignee: Fuji Photo Film Co., Ltd., Kanagawa, Japan

[21] Appl. No.: 258,413

[22] Filed: Oct. 17, 1988

[30] Foreign Application Priority Data

Oct. 16, 1987 [JP] Japan ..... 62-261054

[51] Int. Cl.[5] ..... G03C 1/02

[52] U.S. Cl. ..... 430/567; 430/569

[58] Field of Search ..... 430/867

[56] References Cited

U.S. PATENT DOCUMENTS 4,414,306 11/1983 Wey et al. ..... 430/434
4,527,386 3/1985 Matsuzaka et al. ..... 430/567
4,581,327 4/1986 Habu et al. ..... 430/567

FOREIGN PATENT DOCUMENTS 2110405 6/1983 United Kingdom ..... 430/567

*Primary Examiner*—Paul R. Michl
*Assistant Examiner*—Thorl Chea
*Attorney, Agent, or Firm*—Sughrue, Mion, Zinn, MacPeak & Seas

[57] ABSTRACT

A silver halide photographic emulsion comprising a hydrophilic colloid having dispersed therein tabular silver halide grains having an aspect ratio of at least 2, the grains comprising a matrix comprising at least 50 mol % silver bromide ions based on silver ions, and a high silver chloride layer on the matrix, the high silver chloride layer comprising at least 50 mol % chloride ions based on silver ions and forming a substantially uniform plane on the matrix, wherein at least 50 mol % of the high silver chloride layer is present on two basal plane surfaces of the matrix.

The emulsion has improved pressure properties which are suited for rapid processing, and minimized grain aggregation and excellent suitability for preparation.

20 Claims, 4 Drawing Sheets

SILVER HALIDE PHOTOGRAPHIC EMULSION

FIELD OF THE INVENTION

The present invention relates to a silver halide photographic emulsion, and more particularly, to a silver halide emulsion comprising tabular silver halide grains having an aspect ratio of at least 2 in a dispersing medium.

BACKGROUND OF THE INVENTION

In order to improve sensitivity of a silver halide photographic emulsion and to improve sharpness, graininess and sensitization efficiency using a sensitizer as well as to improve covering power etc., it is known that so called tabular silver halide grains having a grain diameter considerably greater than grain thickness are preferred. Process for producing tabular grains and technology using the same are disclosed in U.S. Pat. Nos. 4,386,146, 4,504,570, 4,478,929, 4,414,304, 4,411,986, 4,400,463, 4,414,306, 4,439,520, 4,433,048, 4,434,226, 4,413,053, 4,459,353, 4,490,458 and 4,399,215.

Also, a recent trend for processing of silver halide light-sensitive materials is directed toward rapid processing.

In general, where the silver chloride content of the grains increases, water solubility increases so that development and fixing are achieved in a shorter period of time and silver halide suited for rapid processing is obtained.

However, silver halide grains having a high silver chloride content generally tend to take the form of cubic grains, and in order to render them tabular grains, certain steps must be taken. With respect to high silver chloride tabular grains having a silver chloride content of 50 mol% or more, a method in which grains are formed without incorporating bromide ions and iodide ions inside, maintaining pAg and pH in ranges of 6.5 to 10 and 8 to 10, respectively and using ammonia is described in U.S. Pat. No. 4,399,215, and a method in which grains are formed in the copresence of aminoazaindene and a peptizer containing a thioether bond is described in U.S. Pat. No. 4,400,463.

In U.S. Pat. No. 4,414,306, there is disclosed a method which comprises simultaneously introducing silver ions, chloride ions and bromide ions and maintaining a molar ratio of the chloride ions to the bromide ions in a reactor in a range of 1.6:1 to 256:1 and a concentration of the total halogen ions in the reactor in a range of 0.10 to 0.90 normality, to allow a silver halide layer having a mean molar ratio of the chloride ions to the bromide ions up to 2:3 to grow in annular tabular grain regions.

Tabular grains containing these chloride ions have an advantage in that processing time for development, fixing, etc. is shortened. However, these type of tabular grains suffer from serious drawbacks inherent to tabular grains in handling, such as fog caused by pressure, desensitization due to pressure, etc. and have properties that are not always preferable from a practical point of view.

In addition, tabular grains tend to become aggregated because the ratio of surface area to volume is large as compared to spherical grains. This often causes problems upon preparation of photographic emulsions or upon coating of these emulsions. This problem is considered to be inherently due to the shape itself of conventional tabular grains.

SUMMARY OF THE INVENTION

An object of the present invention is to provide a silver halide emulsion comprising novel tabular silver halide grains having improved pressure properties which are suited for rapid processing.

Another object of the present invention is to provide a silver halide emulsion comprising novel tabular silver halide grains having minimized grain aggregation and excellent suitability for preparation.

A further object of the present invention is to provide a silver halide emulsion in which improvements in sensitivity, including an improved sensitization efficiency with a sensitizer, in the relationship between sensitivity and graininess, in sharpness, and in covering power, and also the objects mentioned above are achieved simultaneously.

These and other objects and advantages of the present invention are satisfied a silver halide photographic emulsion comprising a hydrophilic colloid having dispersed therein tabular silver halide grains having an aspect ratio of at least 2, the grains comprising a matrix comprising at least 50 mol% silver bromide ions based on silver ions, and a high silver chloride layer on the matrix, the high silver chloride layer comprising at least 50 mol% chloride ions based on silver ions and forming a substantially uniform plane on the matrix, wherein at least 50 mol% of the high silver chloride layer is present on two basal plane surfaces of the matrix.

DETAILED DESCRIPTION OF THE INVENTION

Figure 1:
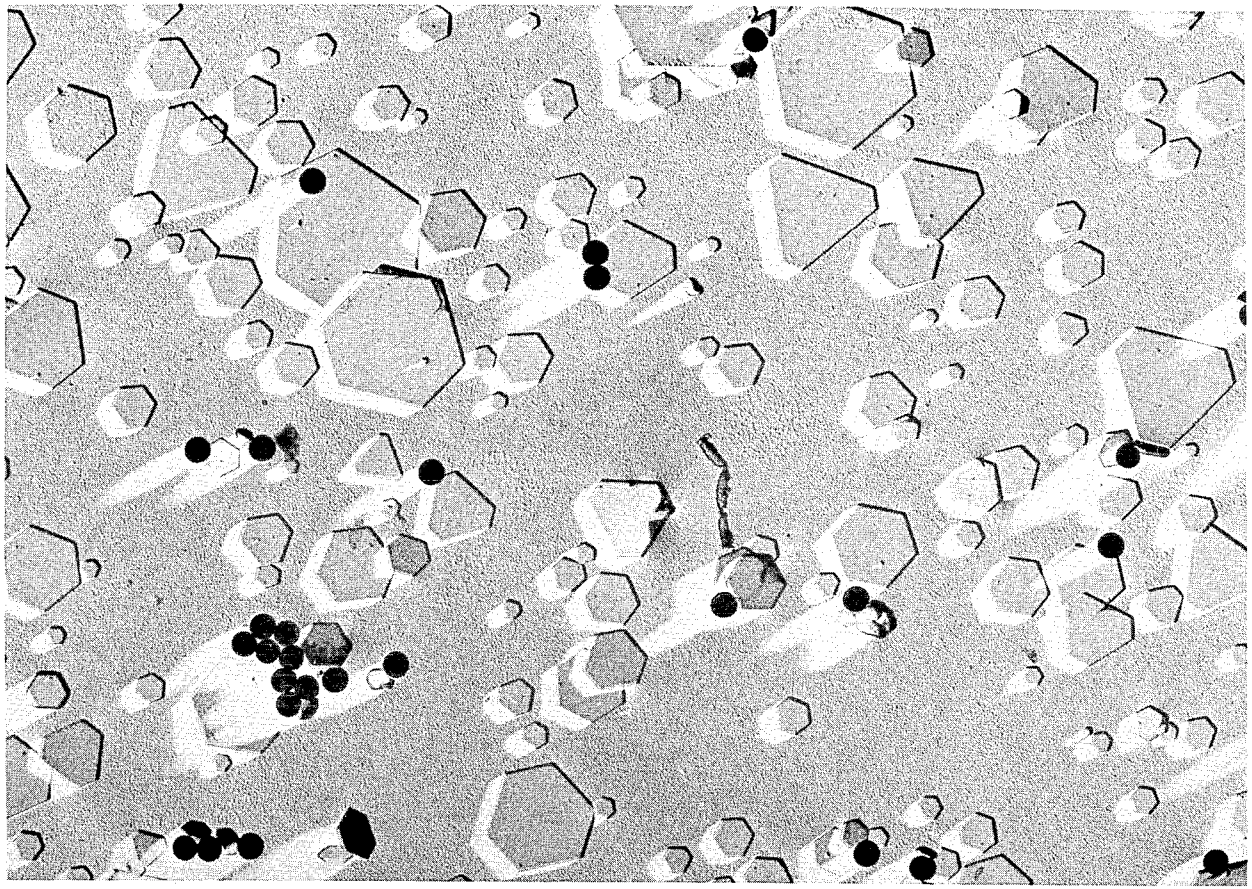
FIG. 1 is a photograph taken by an electron microscope having a magnification of 10,000 showing a crystalline structure of silver halide grains of silver halide emulsion Em-E prepared in Example 1 for purposes of comparison.

One characteristic feature of the silver halide photographic emulsion (hereafter referred to as an emulsion) of the present invention lies in depositing silver halide containing 50 mol% or more chloride ions based on total depositing silver ions on the basal plane surfaces, not in the annular regions, of tabular matrix grains.

The present invention is characterized in that 50 mol% or more, preferably 80 mol% or more and more preferably 90 mol% of the deposited silver halide is deposited on the basal plane surfaces of the matrix grains, whereby little silver halide is deposited on grain surfaces other than the basal plane surfaces of matrix grains.

Accordingly, in the most preferred embodiment of the present invention, the aspect ratio of tabular grains in which silver halide containing 50 mol% or more chloride ions based on the total depositing silver ions are deposited, should always be smaller than the aspect ratio of the tabular matrix grains onto which the silver halide containing this high amount of chloride ions is deposited.

In this regard, the silver halide grains of the present invention are principally distinguished over the tabular grain emulsion disclosed in U.S. Pat. No. 4,414,306.

Further, the silver halide grains of the present invention are also principally distinguished over so called core/shell type emulsions, since the high silver chloride layer is mainly deposited on the basal plane surfaces of the matrix grains.

The tabular matrix grains of the present invention may be any of grains having at least two layer structures, each layer having substantially different halogen compositions, or those having a uniform composition.

With respect to the halogen composition of the matrix grains, it is sufficient that the matrix grains contain at least 50 mol% of bromide ions, preferably 70 mol% or more bromide ions, and 30 mol% or less iodide ions. That is, the matrix grains are preferably composed of silver bromide or silver iodobromide (iodide content of 30 mol% or less).

In the tabular matrix grains having a layered structure of different halogen compositions, they may be either an emulsion containing, for example, a high iodine content layer as the core and a low iodine content layer as the outermost layer, or an emulsion containing, for example, a low iodine content layer as the core and a high iodine content layer as the outermost layer. Also with respect to chlorine, it is optional in the matrix grains. The layered structure may also take the form of 3 or more layers.

The tabular matrix grains of the present invention can be prepared by the following precipitate formation method as described in JP-A-63-11928 and JP-A-63-92942 (the term "JP-A" as used herein means as "unexamined published Japanese patent application"). A dispersing medium is charged in a reactor equipped with a stirring mechanism for forming silver halide precipitates conventionally used. The amount of the dispersing medium charged in the reactor at an initial stage is generally at least about 10 wt%, preferably 20 to 80 wt%, the amount of the dispersing medium present in the emulsion at the final stage for forming grain precipitates. The dispersing medium charged in the reactor at the beginning is water or a dispersing medium of a peptizer in water. If necessary and desired, other components, for example, at least one silver halide solvent and/or at least one metal dopant which will be later described in detail, are formulated in this dispersing medium. In the case that a peptizer is present at the beginning, it is preferred that its concentration be at least 10 wt%, in particular, at least 20 wt%, based on the total amount of peptizer present at the final stage for forming silver halide precipitates. A supplemental dispersing medium is charged in the reactor together with silver and halide salts and can be introduced through a separated jet. In order to increase the ratio of, especially, a peptizer, the ratio of the dispersing medium is generally regulated after completion of the introduction of halide salts.

Specific examples of the peptizer include gelatin, gelatin derivatives such as phthalated gelatin, albumin, agar-agar, gum arabic, cellulose derivatives, polyvinyl acetate, polyacrylamide, polyvinyl alcohol, etc. Of these, gelatin is preferably used.

Generally, less than 10 wt% of bromide salts used for formation of silver halide grains are allowed to be initially present in the reactor, thereby regulating the bromide ion concentration in the dispersing medium at the onset of forming silver halide precipitates. Further, the dispersing medium in the reactor should substantially exclude iodide ions at the beginning. This is because the presence of iodide ions prior to simultaneous addition of silver and bromide salts tends to cause formation of thick, non-tabular grains. Herein the phraseology "should substantially exclude iodide ions" is used to mean that iodide ions may be merely present in an amount insufficient to precipitate as a separate silver iodide phase, as compared to bromide ions. It is desired that the iodine concentration in a reactor prior to introducing silver salts be maintained to less than 0.5 mol% based on the whole halide ion concentration in the reactor. When pBr of the dispersing medium is too high at the beginning, the tabular grains formed become relatively thick and distribution in a grain thickness becomes broad. In addition, non-tabular grains increase. On the other hand, where pBr is too low, non-tabular grains also tend to be formed. The pBr used herein is defined by a negative logarithmic value of the bromide ion concentration.

During the course of forming precipitates, silver, bromide, chloride and iodide salts are charged in the reactor in a manner well known for forming precipitates of silver halide grains, as described in P. Glafkides, *Climie et Physique Photographique,* Paul Montel, 1967), and G. F. Duffin, *Photographic Emulsion Chemistry,* (The Focal Press, 1966). Soluble silver salts such as silver nitrate are generally introduced into the reactor, at the same time that silver, bromide, chloride and iodide salts are introduced thereto. Bromide, chloride and iodide salts are introduced as a salt solution such as an aqueous solution of soluble ammonium, alkali metal (for example, sodium or potassium) or alkaline earth metal (for example, magnesium or calcium) halide salts. The silver salt is introduced into the reactor, at least at the beginning, separately from the bromide salt, chloride salt and iodide salt. The bromide salt, chloride salt and iodide salt may be separately added or introduced as a mixture thereof.

When the silver salt is introduced into the reactor, the stage of forming grains is initiated. Continuous introduction of silver, bromide, chloride and iodide salts causes formation of matrix of grain nuclei useful as locations for forming precipitates of silver bromide, silver chloride and silver iodide. Precipitates of silver bromide, silver chloride and silver iodide are formed on the existing grain nuclei, whereby the grains begin to grow. Conditions for nuclear formation can be determined by reference to the method described in JP-A-63-11928 but is not limited thereto. For example, the nucleus formation can be effected at a temperature ranging from 5 to 55° C.

The size distribution of the tabular matrix grains formed in accordance with the present invention is greatly affected by concentrations of bromide salts, chloride salts and iodide salts at the growth stage. When pBr is too low, tabular grains having a high aspect ratio are formed, but the coefficient of variation of their projected area becomes markedly large. By maintaining pBr between about 2.2 and about 5, tabular grains having a minimized coefficient of variation of the projected area can be formed.

As far as the aforesaid pBr conditions are met, concentrations of silver and bromide, chloride and iodide salts and rates for introduction may be the same as those conventionally used. It is desired to introduce silver and halide salts in a concentration of 0.1 to 5 mols/l, but a broader concentration range conventionally used, for example, a range from 0.01 mol/l to a saturation degree can be employed. A particularly preferred method for forming precipitates is to increase the rates for introducing silver and halide salts to shorten the time period for forming precipitates. The rates for introducing silver and halide salts can be increased either by increasing rates of introducing the dispersing medium as well as silver and halide salts, or by increasing concentrations of silver and halide salts in the dispersing medium to be introduced. By maintaining a rate of adding silver and halide salts around the critical value at which formation of new grain nuclei occurs as described in JP-A-55-142329, the coefficient of variation of projected area of grains can further be reduced.

The amount of gelatin in a reactor upon nucleus formation significantly affects the grain size distribution. As a gelatin concentration, 0.5 to 10 wt% is preferred, more preferably 0.5 to 6 wt%, based on the dispersing medium initially added in the reactor.

Further, the stirring rotation number and shape of the reactor also affect the grain size distribution.

A preferred device for stirring and mixing is described in U.S. Pat. No. 3,785,777 in which a reaction solution is added to liquid and the mixture is mixed. The stirring rotation number should not be too small or too large. With a small stirring rotation number, the ratio of non-parallel twin grains formed increases and where the stirring rotation number is too large, frequency of the tabular grains formed decreases and the size distribution also becomes broad.

The most preferred shape of the reactor is one having a half-round bottom.

Silver halide containing at least 50 mol% of chloride ions based on depositing silver ions is precipitated on the basal plane surfaces of these tabular matrix grains. It is desired that the chloride ions preferably comprise an amount of 60 mol% or more of the silver halide to be deposited. Most preferably, the chloride ions comprise an amount of 70 mol% or more.

The amount of the silver chloride layer deposited is at least 5 mol%, preferably 10 mol% or more, most preferably 20 mol% or more, in mol% calculated as silver based on the tabular matrix grains.

pAg (logarithm of a reciprocal number of silver ion concentration in the reactor) in the reactor upon deposition of the silver chloride layer varies depending upon temperature but is preferably 9 or less, more preferably 8 or less, most preferably 7 or less.

The temperature in the reactor upon deposition of the silver chloride layer is between 20° C. and 80° C., preferably between 30° C. and 80° C., most preferably between 40° C. and 80° C.

The pH in the reactor is maintained generally in a range of 2 to 10, preferably in a range of 4 to 9, during deposition of the silver chloride layer.

It is particularly desired that the grains of the present invention be designed to localize a layer mainly composed of silver bromide around the surface.

To prepare a localized layer mainly composed of silver bromide, a layer having a high silver chloride content may be deposited on the tabular matrix grains as discussed above, and then a water soluble silver salt and a water soluble bromide salt are added to form a shell; alternatively, a water soluble bromide salt alone is added thereto followed by thermal ripening. Further, alternatively, finely divided silver bromide grains may be mixed followed by thermal ripening.

Preparation of the localized layer mainly composed of silver bromide may be any step prior to washing, prior to or after chemical sensitization or prior to coating. The localized layer amount is preferably 0.01 to 10 mol%, more preferably 0.1 to 3 mol%, based on the total silver halide amount contained in the emulsion layer. The amount of silver bromide contained in the localized layer should be greater than the mean silver bromide content in the layer having a high silver chloride content. Preferably, 50 mol% or more of the localized layer is silver bromide, more preferably 70 mol% or more. That is, it is preferred that the silver bromide content be larger by 20 mol% or more, preferably 40 mol% or more, particularly 60 mol% or more, than the mean silver bromide content in the high silver chloride layer. The presence of the localized layer can be analyzed by surface analysis such as XPS (X-ray Photoelectron Spectroscopy), etc.

With respect to the XPS method, reference may be made to Junichi Aihara et al., *Spectrometry of Electron*, Kyoritsu Library 16, published by Kyoritsu Publishing Co., Ltd. (1978).

After the high silver bromide localized layer is formed, another silver halide, such as silver bromide, silver iodobromide, silver iodochlorobromide, silver chlorobromide, silver iodide and silver chloroiodide may optionally be grown on the grains of the present invention.

This is particularly effective for controlling development properties and pressure properties which are the primary objects of the present invention. As a suitable method for these silver halide to be grown on the localized high silver bromide layer, reference may be made to the method described above with respect to the formation of precipitates of the tabular matrix grains.

In the grains of the present invention, halogen can be exchanged, after the high silver chloride layer is formed, with a compound capable of forming a silver salt having a solubility product in water smaller than that of silver chloride. Examples of useful compounds are iodides, thiocyanides, cyanides, carbonates, phosphates and citrates.

In the present invention, it is preferred that the mean diameter of the tabular silver halide grains be 0.5 to 3.0 μm.

The mean thickness of the grains is preferably below 0.5 μm, more preferably below 0.4 μm.

It is preferred that the mean volume of a volume load of the grains be below 2 $\mu m^3$.

The mean volume ($\bar{V}$) of a volume load is expressed by the following equation.

$$V = \frac{\Sigma(niVi)Vi}{\Sigma niVi}$$

*ni*: number of grain
*Vi*: volume of grain

The aspect ratio in the present invention refers to the value obtained by dividing the grain diameter by the grain thickness. The grain diameter is expressed by the diameter of a circle having the same projected area as the grain.

It is preferred that tabular grains having an aspect ratio of at least 2 (preferably at least 3, more preferably at least 5) be present in the emulsion of the present invention in an amount of 50% or more, especially 90% or more, based on the projected area of the whole grains.

It is also preferred that the mean aspect ratio of the total tabular grains having an aspect ratio of at least 2 be 2 to 20, especially 3 to 10.

The tabular silver halide grains of the present invention comprise tabular matrix grains containing 50 mol% or more bromide ions having provided on the basal plane surfaces thereof a high silver chloride-deposited layer having a chloride ion concentration of 50 mol% or more. By taking such a construction, the basal plane surface tends to be somewhat curved.

The basal plane surfaces of conventionally known tabular grains are all parallel planes and, hence, the tabular grains of the present invention having a curved basal plane surface are novel. The parallel basal plane surface of conventional tabular grains generally is the (111) plane. The tabular grains as used herein collectively refers to grains having one, or two or more parallel twin planes. The twin plane refers to the plane where ions at all lattices are in a mirror image relationship at both sides of (111) plane in this case. When the grains are viewed from above, the tabular grains are of triangular or hexagonal shape or a circular shape of a triangle or hexangle with round edges. The triangular, hexagonal and circular shapes possess triangular, hexagonal and circular outer surfaces, respectively, which are parallel to each other.

To determine the thickness of these tabular grains, a metal is deposited from a direction oblique to the grains together with latex for reference and the length of its shadow is measured on a photograph taken by an electron microscope and a calculation is made, using a length of shadow of the latex for reference.

Conventional tabular grains having the basal plane surfaces parallel to each other so that the shape of the metal shadow formed by silver halide grains deposited from the oblique direction is always almost identical with the shape of silver halide that forms the shadow, viewed from right above. Accordingly, triangular, hexagonal and circular tabular grains possess triangular, hexagonal and circular shadow shapes, respectively. Conventionally known tabular grains satisfy this relationship as a matter of course.

The tabular grains of the present invention having the curved basal plane surfaces are of so called dish-like shape. That is, the basal plane surfaces are curved toward the upper surface or the lower surface. The upper surface and lower surface as used herein may be optionally determined.

Where tabular grains are curved when a carbon replica specimen of silver halide emulsion grains is formed on a mica support, there are cases in which a dish-like lower surface, namely, a convex portion, becomes the lower surface, and cases in which a dish-like upper surface, namely, a concave portion, becomes the lower surface. In the former case, a length of the shadow at the apex of a hexagon is the longest and shadow of the sides between the apices becomes shorter as it goes away from the apices, in the case of hexagonal tabular grains. Therefore, when the shadow is viewed from the grains, a convex shadow shape is given below. In the latter case, a shadow of the tabular grains is formed by the basal plane surfaces, not by the sides. Therefore, when the shadow is viewed from the grains, a convex shadow shape is given above. The thickness of the tabular grains of the present invention having the curved basal plane surfaces cannot be accurately measured by the aforesaid method for measuring a shadow length using latex as a reference.

The aspect ratio of the curved tabular grains in the present invention is defined as follows, for purposes of convenience. The thickness of the tabular grains is determined by measuring the shortest length of shadow using latex as a reference. The grain diameter is determined by measuring a 2-dimensional area on a photograph taken by an electron microscope, ignoring the 3-dimensional spread of the tabular grains, and correcting the photographic magnification. The tabular grains having the curved basal plane surfaces which can be judged by the shadow of the photograph taken by an electron microscope are contained preferably by 5 or more grains from among 100 or so grains. In the curved tabular grains, 10 or more such grains are more preferably present from among these 100 or so grains. Most preferably, 20 or more such grains are present.

The tabular grain emulsion of the present invention may be any of an internal latent image type tabular grain emulsion or surface latent type tabular grain emulsion.

A suitable silver halide solvent used in the preparation of the emulsion of the present invention includes thiocyanates, thioethers and thioureas. Further, ammonia may also be used in combination within a range that does not provide adverse effects.

Examples include thiocyanates (U.S. Pat. Nos. 2,222,264, 2,448,534 and 3,320,069), thioethers (for example, U.S. Pat. Nos. 3,271,157, 3,574,628, 3,704,130, 4,297,439 and 4,276,347) and thione compounds (for example, JP-A-53-144319, JP-A-53-82408 and JP-A-55-77737), amine compounds (for example, JP-A-54-100717) and the like.

During the course of formation of silver halide grains or physical ripening, a cadmium salt, a zinc salt, a lead salt, a thalium salt, an iridium salt or a complex thereof, a rhodium salt or a complex thereof, an iron salt or a complex thereof may be co-present as a metal dopant. In particular, an iridium salt or a rhodium salt is preferred.

The tabular silver halide grains of the present invention may be chemically unsensitized but if necessary and desired, may be chemically sensitized.

As the chemical sensitization, there may be used, singly or in combination of two or more, a gold sensitization method using a gold compound, a sensitization method with a metal such as iridium, platinum, rhodium or palladium, a sulfur sensitization method using a sulfur-containing compound and a reduction sensitization method using tin salts, thiourea dioxide polyamine, etc.

Particularly in view of saving silver, the tabular silver halide grains are preferably subjected to gold sensitization or sulfur sensitization or combination thereof.

Ordinary silver halide grains may be incorporated in the emulsion layer of the silver halide photographic emulsion in accordance with the present invention, in addition to the tabular silver halide grains.

The silver halide grains may also be spectrally sensitized by methine dyes or the like. Suitable dyes include a cyanine dye, a merocyanine dye, a complex cyanine dye, a complex merocyanine dye, a holopolar cyanine dye, a hemicyanine dye, a styryl dye and a hemioxonol dye. Particularly useful dyes are a cyanine dye, a merocyanine dye and a complex merocyanine dye. Any of nuclei ordinarily utilized for cyanine dyes as a basic heterocyclic nucleus is applicable to these dyes. That is, a pyrroline nucleus, an oxazoline nucleus, a thiazoline nucleus, a pyrrole nucleus, a oxazole nucleus, a thiazole nucleus, a selenazole nucleus, an imidazole nucleus, a tetrazole nucleus and a pyridine nucleus; nuclei formed by fusing an alicyclic hydrocarbon ring to these nuclei; and nuclei formed by fusing an aromatic hydrocarbon ring to these nuclei, namely, an indolenine nucleus, a benzindolenine nucleus, an indole nucleus, a benzoxazole nucleus, a naphthoxazole nucleus, a benzothiazole nucleus a naphthothiazole nucleus, a benzoselenazole nucleus, a benzimidazole nucleus and a quinoline nucleus, may be used. These nuclei may also be substituted on a carbon atom.

To the merocyanine dye or the complex merocyanine dye, there may be applied, as a nucleus having a ketomethylene structure, a 5- to 6-membered heterocyclic nucleus such as a pyrazolin-5-one nucleus, a thiohydantion nucleus, a 2-thioxazolidine-2,4-dione nucleus, a thiazolidine-2,4-dione nucleus, a rhodanine nucleus and a thiobarbituric acid nucleus.

For example, compounds described in *Research Disclosure*, No. 17643, page 23, Section IV (December, 1978) or compounds described in cited publications therein can be used.

The time for adding a dye in the emulsion may be any stage during preparation of the emulsion which is known to be useful. Most generally, the dye is added in the period from after completion of chemical sensitization to prior to coating. However, the dye may be added at the same time that a chemical sensitizer is added, whereby spectral sensitization is performed either simultaneously with chemical sensitization as described in U.S. Pat. Nos. 3,628,969 and 4,225,666 or, prior to chemical sensitization as described in JP-A-58-113928. Alternatively, the dye may be added prior to completion of forming precipitates of silver halide grains to initiate spectral sensitization.

The silver halide emulsion of the present invention may be used in any type of color photographic light-sensitive material or black-and-white photographic light-sensitive material.

For example, suitable color photographic light-sensitive materials include color paper, a film for color motion picture, a color reversal film and a heat developable light-sensitive material, such as described in EP-A-210660. Suitable black-and-white photographic light-sensitive materials include a film for X-ray, a film for ordinary photography and film for printing light-sensitive material. The emulsion can be preferably used particularly for a film for color motion pictures and color papers.

With respect to other additives to the photographic light-sensitive material to which the emulsion of the present invention is applied, there is no particular limitation and reference may be made to, for example, *Research Disclosure*, 176, No. 17643 (RD 17643) and ibid., 187, No. 18716 (RD 18716).

Portions of RD 17643 and RD 18716 in which various additives are described are listed below:

| Kind of Additive | RD 17643 | RD 18716 |
|---|---|---|
| 1. Chemical sensitizer | page 23 | page 648, right column |
| 2. Sensitivity enhancer | | page 648, right column |

-continued

| Kind of Additive | RD 17643 | RD 18716 |
|---|---|---|
| 3. Spectral sensitizer supersensitizer | pages 23–24 | page 648, right column to page 649, right column |
| 4. Whitening agent | page 24 | |
| 5. Antifoggant and stabilizer | pages 24–25 | page 649, right column |
| 6. Light absorbent, filtering dye and UV absorbent | pages 25–26 | page 649, right column to page 650, left column |
| 7. Antistaining agent | page 25, right column | page 650, left column to right column |
| 8. Dye image stabilizer | page 25 | |
| 9. Hardening agent | page 26 | page 651, left column |
| 10. Binder | page 26 | page 651, left column |
| 11. Plasticizer, lubricant | page 27 | page 650, right column |
| 12. Coating aid, Surfactant | pages 26–27 | page 650, right column |
| 13. Antistatic agent | page 27 | page 650, right column |

Among the additives described above, preferably used as the antifoggant and stabilizer include an azole (for example, a benzothiazolium salt, a nitroimidazole, a nitrobensimidazole, a chlorobenzimidazole, a bromobenzimidazole, a nitroindazole, a benzotriazole and an aminotriazole); a mercapto compound (for example, a mercaptothiazole, a mercaptobenzothiazole, a mercaptobenzimidazole, a mercaptothiadiazole, a mercaptotetrazole (in particular, 1-phenyl-5-mercaptotetrazole), a mercaptopyrimidine and a mercaptotriazine); a thioketo compound, for example, oxazolinethione; an azaindene (for example, a triazaindene, a tetraazaindene (in particular, a 4-hydroxy-substituted (1,3,3a,7)tetraazaindene) and a pentaazaindene); benzenethiosulfonic acid, benzenesulfinic acid and benzenesulfonamide.

Non-diffusible couplers containing a hydrophobic group called a ballast group or polymerized couplers are described as a color coupler. The coupler may be 4-equivalent or 2-equivalent to silver ions. Further, a colored couplers having a color correction effect and a coupler capable of releasing a development inhibitor accompanied by development (so called DIR coupler) may also be used. Furthermore, a colorless DIR coupling compound capable of releasing a development inhibitor in which the coupling reaction product is colorless may also be present.

Examples of magenta couplers include a 5-pyrazolone coupler, a pyrazolobenzimidazole coupler, a pyrazolotriazole coupler, a pyrazolotetrazole coupler a cyanoacetylcounmarone coupler and an open-chain acylacetonitrile coupler; examples of yellow couplers include an acylacetamide coupler (for example, a benzoylacetanilide and a pivaloylacetanilide) and; examples of cyan couplers include a naphthol coupler and a phenol coupler. As the cyan coupler, there are preferred a phenol coupler having an ethyl group at the m-position of the phenol nucleus, a 2,5-diacylamino-substituted phenol coupler, a phenol coupler having a phenylureido group at the 2-position and an acylamino group at the 5-position and a coupler having substituted sulfonamido or amido at the 5-position of naphthol, as described in U.S. Pat. Nos. 3,772,002, 2,772,162, 3,758,308, 4,126,396, 4,334,011, 4,327,173, 3,446,622, 4,333,999, 4,451,559 and 4,427,767, because of excellent fastness of images.

The couplers described above may be used in the same layer in combination of two or more, for purposes of meeting properties sought for the light-sensitive material. Of course, the same compound may also be incorporated in two or more different layers.

Representative examples of anti-color fading agents include a hydroquinone, a 6-hydroxychroman, a 5-hydroxy-coumarane, a spirochroman, a p-alkoxyphenol, a hindered phenol including a bisphenol, a gallic acid derivative, a methylene-dioxybenzene, an aminophenol, a hindered amine and an ether or ester derivative obtained by silylation and alkylation of the phenolic hydroxy group in these compounds. In addition, a metal complex represented by a (bis-salicylaldoxymate) nickel complex and a (bis-N,N-dialkyldithiocarbamate) nickel complex may also be used.

For photographic processing of the light-sensitive material using the emulsion of the present invention, any of known processing methods and known processing solutions are usable. A processing temperature is chosen generally between 18° C. and 50° C. but may be a temperature lower than 18° C. or higher than 50° C., if necessary. Depending upon purpose, any of development processing for forming silver images (black-and-white processing) and color development processing comprising development processing for forming color images may be applied.

As a black-and-white developer, there may be used, singly or in combination, known developing agents such as a dihydroxybenzene (for example, hydroquinone), a 3-pyrazolidone (for example, 1-phenyl-3-pyrazolidone) or an aminophenol (for example, N-methyl-p-aminophenol).

A color developer used for development processing of the light-sensitive material according to the present invention is an alkaline aqueous solution containing as a main component, preferably an aromatic primary amine color developing agent. As the color developing agent, an aminophenol compound is also useful but a p-phenylenediamine compound is preferably used. Representative examples of the p-phenylenediamine compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethyaniline, 3-methyl-4-amino-N-ethyl-N-β-methoxyethylaniline and a sulfate, hydrochloride or p-toluenesulfonate thereof. These compounds may be used in combination of two or more, depending upon purpose.

In general, the color developer contains an alkali metal carbonate, a pH buffering agent such as a borate or phosphate, a bromide salt, a chloride salt, a development inhibitor such as a benzimidazole, a benzothiazole or a mercapto compound or an antifogging agent. Further, if necessary and desired, the color developer may also contain various preservatives such as hydroxylamine, diethylhydroxylamine, a sulfite hydrazine, a phenylsemicarbazide, triethanolamine, a catecholsulfonic acid and a triethylenediamine-(1,4-diazabicyclo[2.2.-2]octane; an organic solvent such as ethylene glycol and diethylene glycol; a development accelerator such as benzyl alcohol, polyethylene glycol, a quaternary ammonium and an amine; a dye forming coupler; a competitive coupler; a fogging agent such as a sodium borohydride; an auxiliary developing agent such as 1-phenyl-3-pyrazolidone; a viscosity imparting agent; various chelating agents represented by an aminopolycarboxylic acid, an aminopolyphosphonic acid, an alkylphosphonic acid and a phosphonocarboxylic acid (representative examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylene-diamine-N,N,N',N'-tetramethylenephosphonic acid, ehtylene-diamine-di(o-hydroxyphenylacetic acid) and salts thereof).

Further, in the case of performing reversal processing, black-and-white development is generally followed by color development. As a black-and-white developer, there may be used, singly or in combination, known black-and-white developers such as a dihydroxybenzene (e.g., hydroquinone), a 3-pyrazolidone (e.g., 1-phenyl-3-pyrazolidone) or an aminophenol (e.g., N-methyl-p-aminophenol).

The pH of these color and black-and-white developers is generally in a range of 9 to 12. A replenishing amount of these developers is generally 3 liters or less per 1 square meter of the light-sensitive material, although the exact amount depends on the color photographic light-sensitive material to be processed. By reducing the bromide ion concentration in a replenishing solution, the amount may be reduced to 500 ml or less. In the case of reducing the replenishing amount, it is preferred that a contact area with air in a processing tank be minimized thereby to prevent evaporation of the solution and aerial oxidation. Further, by applying a means for preventing accumulation of bromide ions in the developer, the replenishing amount may also be reduced.

The photographic emulsion layer after color development is generally subjected to bleaching processing. The bleaching and fixing processing may be conducted at the same time (blixing processing) or independently. In order to attain more rapid processing, blixing processing may also be performed after fixing processing. Further depending upon purpose, processing may be conducted in two continuous blixing bathes, fixing may be done prior to blixing or, bleaching may be done after blixing. As a bleaching agent, there may be used a compound of polyvalent metal (for example, iron (III), cobalt (III), chromium (VI) and copper (II)), a peracid, a quinone and a nitro compound. As representative bleaching agents, there may be used a ferricyanide; a bichromate; an organic complex salt of iron (III) or cobalt (III) (for example, a complex salt of an aminopolycarboxylic acid such as ethylenediaminetetraacetic acid, diethylenetriaminepentaacetic acid, cyclohexanediaminetetraacetic acid, methyliminodi-acetic acid, 1,3-diaminopropanetetraacetic acid, and glycol either diaminetetraacetic acid, or citric acid, tartaric acid and malic acid); a persulfate; a bromate; a permanganate; and a nitrobenzene. Among them, aminopolycarboxylic acid-iron (III) complex salts including ethylenediaminetetraacetic acid-iron (III) complex salt and persulfates are preferred in view of rapid processing and prevention of environmental pollution. The aminopolycarboxylic acid-iron (III) complex salts are particularly useful both in a bleaching solution and in a blixing solution. The pH of the bleaching solution or blixing solution using these aminopolycarboxylic acid-iron (III) complex salts is generally in a range of 5.5 to 8 but for purposes of rapid processing, processing may also be effected at a lower pH.

In the bleaching solution, the blixing solution and a bath prior thereto, a bleach accelerator may be used, if necessary and desired. Specific examples of useful bleach accelerators are described in the following publications: compounds containing a mercapto group or a disulfide bond described in U.S. Pat. No. 3,893,858, West German Pat. No. 1,290,812, JP-A-53-95630 and *Research Disclosure,* No. 17129 (July, 1978); thiazolidine derivatives described in JP-A-50-140129; thiourea derivatives described in U.S. Pat. No. 3,706,561; iodide salts described in JP-A-58-16235; polyoxyethylene compounds described in West German Pat. No. 2,748,430; polyamine compounds described in JP-B-45-8836 (the term "JP-B" as used herein means an "examined Japanese patent publication"); and bromide ions. Among these, the compounds containing a mercapto group or a disulfide bond are preferred in view of an excellent accelerating effect; in particular, the compounds described in U.S. Pat. No. 3,893,858, West German Pat. No. 1,290,812 and JP-A-53-95630 are preferred. Further, compounds described in U.S. Pat. No. 4,552,834 are also preferred. These bleach accelerators may also be incorporated into the light-sensitive material. These bleach accelerators are particularly effective for bleach-fixing color light-sensitive materials for motion pictures.

The fixing agent includes, for example, a thiosulfate, a thiocyanate, a thioether compound, a thiourea and large quantities of iodide salt. It is common to use the thiosulfate. In particular, ammonium thiosulfate is most widely used. As a preservative for the bleach-fixing solution, sulfites, bisulfites or carbonylbisulfite addition products are preferred.

In general, the silver halide color photographic light-sensitive material of the present invention is subjected to washing and/or stabilizing steps, after desilvering. The amount of washing water in the washing step may be determined over a wide range, depending upon properties of the light-sensitive material (for example, depending upon particular materials to be used, such as couplers), use, temperature for washing, number (step number) of washing tanks, replenishing mode whether countercurrent or normal current, and other various conditions. Among them, the relationship between the number of washing tanks and amount of water in a multiple countercurrent mode can be determined by the method described in *Journal of the Society of Motion Picture and Television Engineers,* 64, pp. 248–253 (May, 1955).

According to the multiple countercurrent mode described in the publication described above, the amount of washing water can be greatly reduced but a problem is encountered in that due to an increased residence time of water in a tank, bacteria grow and the formed suspension adheres to the light-sensitive material, and the like. One measure for solving such a problem in processing of the color light-sensitive material of the present invention is the method for reducing calcium ions and magnesium ions described in JP-A-62-288838. This method can be extremely effectively used. Furthermore, there may be used isothiazolone compounds or thiabendazoles described in JP-A-57-8542, chlorine bactericides such as chlorinated sodium isocyanurate and other benzotriazoles and bactericides described in Hiroshi Horiguchi, *Chemistry of Antibacterial and Antimould Agents, Sterilization, Bactericide and Antimould Technology,* edited by the Association of Hygienic Technology, and *Dictionary of Bactericide and Antimould,* edited by the Society of Bactericide and Antimould.

The pH of the washing water used in processing of the light-sensitive material of the present invention is in a range of 4 to 9, preferably 5 to 8. The temperature for washing and the time period for washing may be optionally set depending upon properties, utility or the like of the light-sensitive material but in general, a range of 15 to 45° C. for 20 seconds to 10 minutes, preferably 25 to 40° C. for 30 seconds to 5 minutes is chosen. In addition, the light-sensitive material of the present invention can be directly processed with a stabilizing solution, in place of the washing described above. In such a stabilizing processing, known methods described in JP-A-57-8543, JP-A-58-14834 and JP-A-60-220345 can all be used.

Following the washing described above, stabilization may further be applied and as an example, mention may be made of a stabilizing bath containing formalin and a surface active agent which is used as a final bath for the color light-sensitive material for motion pictures. Various chelating agents and antimould agents may also be added to the stabilizing bath.

An overflow solution accompanied by the washing and/or replenishing the stabilizing solution described above may also be re-used in steps of desilvering or the like.

For purposes of simplifying processing and rapid processing, a color developing agent may also be incorporated into the silver halide color photographic light-sensitive material. In order to incorporate such, it is preferred to use a variety of precursors of the color developing agent. Examples include indoaniline compounds described in U.S. Pat. No. 3,342,597; Schiff's base compounds described in U.S. Pat. No. 3,342,599, *Research Disclosure,* Nos. 14850 and 15159; aldol compounds described in *Research Disclosure,* No. 13924; metal salt complexes described in U.S. Pat. No. 3,719,492; and urethane compounds described in JP-A-53-135628.

For purposes of accelerating color development, if necessary and desired, various 1-phenyl-3-pyrazolidones may also be incorporated into the silver halide color photographic light-sensitive material of the present invention. Typical compounds are described in JP-A-56-64339, JP-A-57-144547 and JP-A-58-115438.

Various processing solutions in the present invention are used between 10° C. and 50° C. A temperature of 33° C. to 38° C. is generally standard but at a higher temperature, the processing may be accelerated to shorten the processing time; or conversely, at a lower temperature, improvement in image quality or improvement in stability of the processing solution may be achieved. In order to save silver in the light-sensitive material, processing using intensification with cobalt or intensification with hydrogen perioxide described in West German Pat. No. 2,226,770 and U.S. Pat. No. 3,674,499 may also be applied.

Hereafter the present invention will be described by referring to particular examples thereof, but is not deemed to be limited thereto. Unless otherwise indicated, all parts, parcents, ratios and the like are by weight.

EXAMPLE 1

While stirring, 1,000 ml of an aqueous solution containing 32 g of gelatin and 3 g of KBr was kept at 40° C. A silver nitrate aqueous solution ($AgNO_3$, 32.7 g) and a halogen aqueous solution (KBr, 23.8 g; KI, 2.8 g) were added to the aqueous solution simultaneously over 4 minutes. Four minutes after completion of the addition, the temperature of the solution was elevated to 75° C. A KBr aqueous solution (KBr, 7 g) was added thereto followed by ripening for 30 minutes. A silver nitrate aqueous solution was added to make the silver potential of the reaction solution +50 mV to saturated caromel electrodes. This emulsion (Em-A) provided tabular matrix grains having a mean grain diameter of 1.0 μm, mean grain thickness of 0.10 μm, mean aspect ratio of 10 and coefficient of variation of 65%.

Em-B through Em-E shown below were prepared from the tabular matrix grains.

Em-A was kept at 75° C. and a silver nitrate aqueous solution ($AgNO_3$, 8.7 g) and an NaCl aqueous solution were added to the aqueous solution simultaneously over 4.8 minutes. In this case, the silver potential of the reaction solution was maintained at +50 mV to saturated caromel electrodes. This emulsion was made Em-B.

Em-A was kept at 75° C. and a silver nitrate aqueous solution ($AgNO_3$, 17.4 g) and an NaCl aqueous solution were added to the aqueous solution simultaneously over 4.8 minutes. In this case, the silver potential of the reaction solution was maintained at +50 mV to saturated caromel electrodes. This emulsion was made Em-C.

Em-A was kept at 75° C. and a silver nitrate aqueous solution ($AgNO_3$, 34.8 g) and an NaCl aqueous solution were added to the aqueous solution simultaneously over 9 minutes. In this case, the silver potential of the reaction solution was maintained at +50 mV to saturated caromel electrodes. This emulsion was made Em-D.

Em-A was kept at 75° C. and a silver nitrate aqueous solution ($AgNO_3$, 8.7 g) and a KBr aqueous solution were added to the aqueous solution simultaneously over 4.8 minutes. In this case, the silver potential of the reaction solution was maintained at +50 mV to saturated caromel electrodes. This emulsion was made Em-E.

Carbon replica samples of Em-B, C, D and E were prepared and the prepared grains were observed by an electron microscope. The obtained results are shown in Table 1.

TABLE 1

Figure 2:
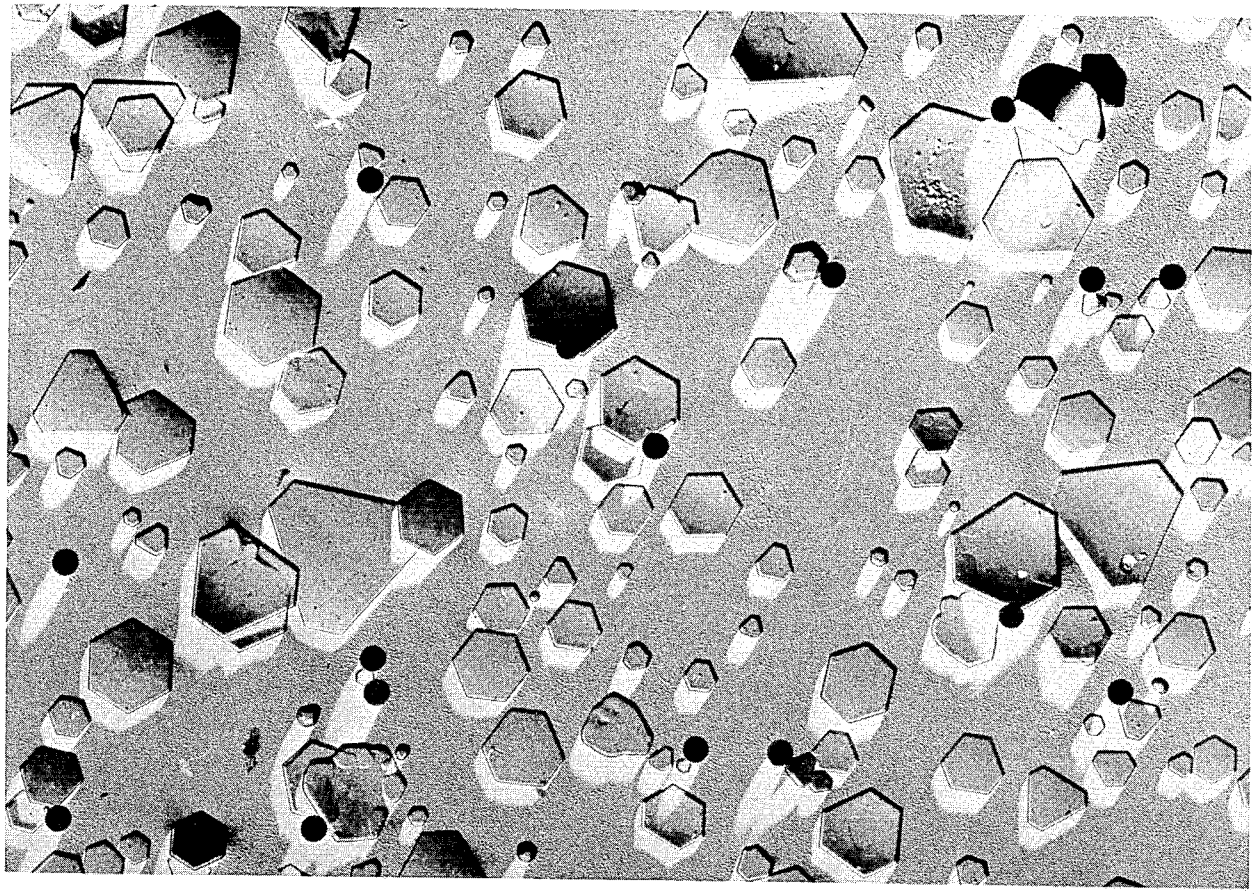
FIG. 2 is a photograph taken by an electron microscope having a magnification of 10,000 showing a crystalline structure of silver halide grains of silver halide emulsion Em-B in accordance with the present invention, prepared in Example 1.

| Emulsion | State of Basal Plane Surfaces | Drawing | Emulsion |
|---|---|---|---|
| Em-B | curved | FIG. 2 | Invention |
| Em-C | curved | — | Invention |
| Em-D | curved | — | Invention |
| Em-E | not curved | FIG. 1 | Comparison |

Figure 3:
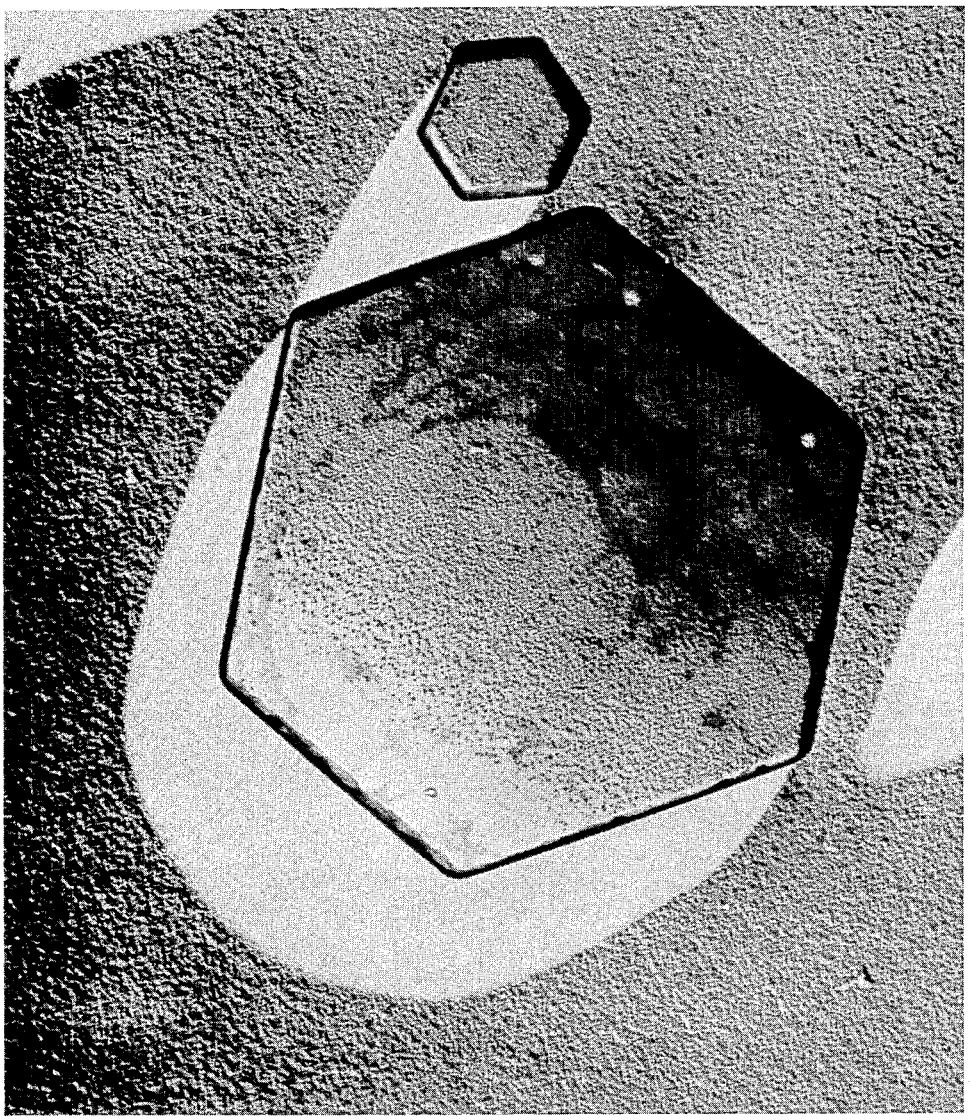
FIGS. 3 and 4 are photographs taken by an electron microscope having a magnification of 60,000 showing a crystalline structure of representative silver halide grains of silver halide emulsion Em-B in accordance with the present invention, prepared in Example 1.
Figure 4:
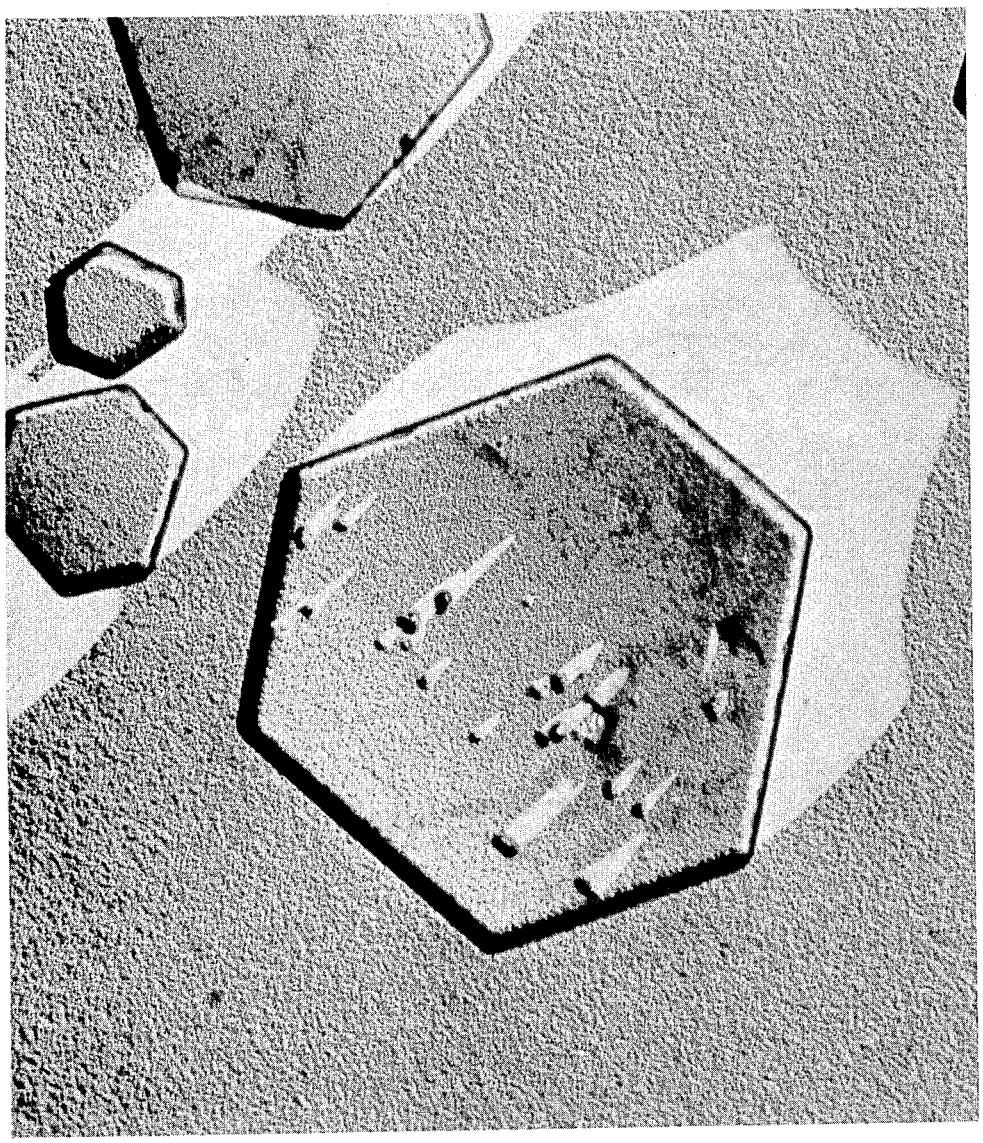

Electron microscopic photograph of Em-B and Em-E according to the carbon replica method are shown in FIG. 2 and FIG. 1, respectively. The basal plane surfaces of Em-E are parallel but not curved. On the other hand, the basal plane surfaces of Em-B are curved. Electron microscopic photographs of Em-B with a high magnification are shown in FIGS. 3 and 4. It is clear from the shape of the shadow that the grains are curved to the upper and lower sides, respectively.

Em-B, C, D and E were washed with water by conventional flocculation method. After desalting, gelatin was added thereto and its pH was adjusted to 6.4 and pAg to 7.5 at 40° C. Each emulsion was chemically sensitized most suitably using diphenylthiourea.

Em-B and Em-E were kept at 40° C. and passed through a filter having small pores of 3 μm, whereby a filtering test of the emulsions was performed. When 2 liters each of the emulsions was filtered, an increase in filtering pressure of Em-B was 0.15 kg. On the other hand, an increase in filtering pressure of Em-E was 0.25 kg. In the emulsion of the present invention, Em-B, aggregation of the grains was obviously improved.

The following Samples 1 through 4 were prepared from 5 Em-B, C, D and E.

Additives as shown in Table 2 were added to a triacetyl cellulose film support having provided thereon a subbing layer and a protective layer was further provided thereon to prepared a light-sensitive material.

TABLE 2

(1) Emulsion layer

Emulsion: Emulsion shown in Table 1

Coupler:

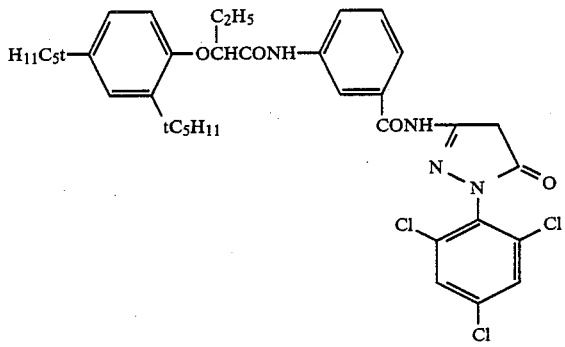

Sensitizer:

5,5'-Diphenyl-9-ethyl-3,3'-di(3-sulfopropyl)-oxacarbocyanine sodium salt

Stabilizer:

4-Hydroxy-6-methyl-1,3,3a,7-tetraazaindene Coating aid: Sodium dodecylbenzenesulfonate Tricresyl phosphate Gelatin (2) Protective layer 2,4-Dichlorotriazine-6-hydroxy-s-triazine sodium salt Gelatin These samples were exposed to light for sensitometry through a yellow filter followed by the following color development processing.

With respect to the processed samples, each density was measured through a green filter. The results of photographic properties obtained are shown in Table 3.

Development processing used herein was performed at 38° C. under the following conditions.

| | |
|---|---|
| 1. Color Development | 30 seconds, 1 minute and 15 seconds, 3 minutes and 15 seconds |
| 2. Bleaching | 6 minutes and 30 seconds |
| 3. Washing | 3 minutes and 15 seconds |
| 4. Fixing | 6 minutes and 30 seconds |
| 5. Washing | 3 minutes and 15 seconds |
| 6. Stabilizing | 3 minutes and 15 seconds |

Compositions of processing solution used in the respective steps are those as described below.

| | |
|---|---|
| Color developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)-2-methylaniline sulfate | 4.5 g |
| Water to make | 1 liter |
| Bleaching solution: | |

-continued

| | |
|---|---|
| Ammonium bromide | 160.0 g |
| Ammonia water (28%) | 25.0 ml |
| Sodium ethylenediamine-tetraacetate | 130 g |
| | 130 g |
| Glacial acetic acid | 14 ml |
| Water to make | 1 liter |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing solution: | |
| Formalin | 8.0 ml |
| Water to make | 1 liter |

With respect to the processed samples, each density was measured and the results obtained are shown. The sensitivity is expressed by the reciprocal number of an exposure amount necessary to give an optical density of fog +1.0 and the 3'15" value of Sample 4 was made 100. The fog value showed a fog value of 3'15". Furthermore, after each sample was folded at an angle of $\phi=6$ mm, the sample was exposed and developed to examine pressure properties (pressure desensitization and pressure fog). Symbols o, x and Δ show a level that withstands practical use, a level that does not withstand practical use and an intermediate level, respectively.

TABLE 3

| | Sample 1 (This Invention) Em-B | Sample 2 (This Invention) Em-C | Sample 3 (This Invention) Em-D | Sample 4 (Comparative Example) Em-E |
|---|---|---|---|---|
| Sensitivity | | | | |
| 30" | 80 | 120 | 150 | 20 |
| 1'15" | 135 | 170 | 230 | 50 |
| 3'15" | 150 | 190 | 250 | 100 |
| Fog | 0.13 | 0.15 | 0.20 | 0.30 |
| Pressure fog | o | o | o | x |
| Pressure desensitization | o | o | o | o |

As shown in Table 3, development acceleration of the tabular emulsions of the present invention is extremely fast.

Further preferred characteristics are shown also in a sensitivity/fog ratio when spectrally sensitized. It is also understood that when the light-sensitive materials were folded or rubbed, practically important requirements that the change in properties be minimized, are met.

EXAMPLE 2

The results obtained when compared with a conventionally known so called core/shell emulsion will be explained.

In a manner similar to Em-D of Example 1, tabular grains were formed. Then, $10^{-2}$ mol of potassium bromide was added to the grains per 1 mol of silver, whereby a layer composed of silver bromochloride was localized around the surface of the grains. Then, chemical sensitization was most suitably performed in a manner similar to Example 1 to give Emulsion Em-F.

A gelatin aqueous solution containing ammonia was kept at 50° C. While stirring, a silver nitrate aqueous solution ($AgNO_3$, 32.7 g) and a KBr aqueous solution (containing 10 wt% of KI) were added to the aqueous solution were added to the aqueous solution simultaneously over 10 minutes. In this case, the silver potential of the reaction solution was maintained at +50 mV to saturated caromel electrodes. Thereafter, a silver nitrate aqueous solution ($AgNO_3$, 34.8 g) and an NaCl aqueous solution were added to the aqueous solution simultaneously over 9 minutes. In this case, the silver potential of the reaction solution was maintained at +50 mV at the same time. $10^{-2}$ mol of potassium bromide was added to the grains per 1 mol of silver, whereby a layer composed of silver bromochloride was localized around the surface of the grains. Then, chemical sensitization was most suitably performed in a manner similar to Example 1 to give Emulsion Em-G. Em-G was a monodispersed cube and its diameter corresponding to a circle was 0.52 μm.

The following compounds were added to Em-F and Em-G, respectively:

Blue-sensitive sensitizing dye (a)

Yellow coupler (b)

Dye image stabilizer (c)

Yellow coupler (b)

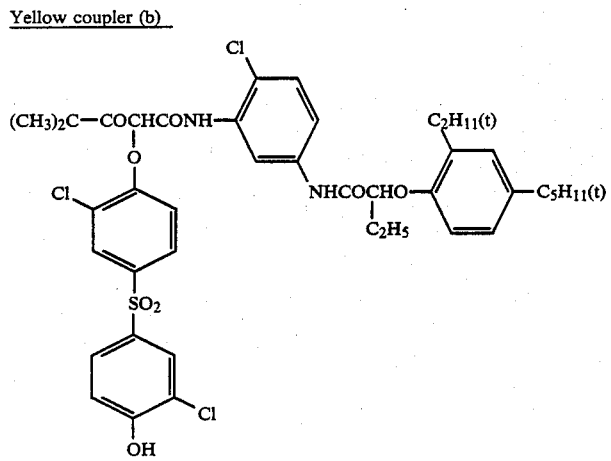

Dye image stabilizer (c)

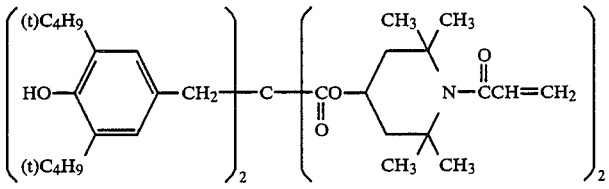

Blue-sensitive sensitizing dye (a)

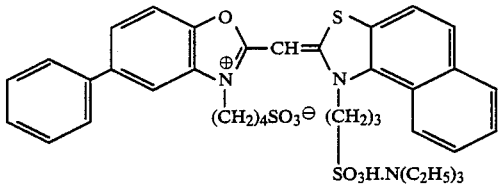

In addition, the following compounds:

Stabilizer : 4-Hydroxy-6 methyl-1,3,3a,7-tetraazaindene

Antifogging agent : 1-phenyl-5-mercaptotetrazole

Hardener : 2,4-Dichloro-6 hydroxy-s-triazine sodium

Coating aid : Sodium dodecylbenzenesulfonate were sequentially added and the resulting mixture was coated onto a paper support having been laminated with polyethylene on both surfaces thereof, together with a gelatine protective layer. Thus Samples 5 and 6 were obtained.

Each sample was exposed through an optical wedge and subjected to development processing according to steps described below to give the results shown in Table 4.

A relative sensitivity is expressed by a reciprocal number of an exposure amount necessary to give an optical density of fog + 1.0 and the 3'30" value of Sample 6 is made 100.

As is clear from Table 4, the emulsion of the present invention, Em-F, has a much higher sensitivity as compared to comparative emulsion Em-g. Furthermore, acceleration of the development is extremely fast and it is clear that the emulsion is suited for rapid processing.

TABLE 4

| Sample No. | Emulsion | Relative Sensitivity 30" | 1' | 3'30" |
|---|---|---|---|---|
| Sample 5 | Em-F (This Invention) | 150 | 240 | 300 |
| Sample 6 | Em-G (Comparative Example) | 10 | 50 | 100 |

| Composition of color developer: (development at 33° C.) | |
|---|---|
| Water | 800 cc |
| Diethylenetriaminepentaacetic acid | 1.0 g |
| Sodium sulfite | 0.2 g |
| N,N-Diethylhydroxylamine | 4.2 g |
| Potassium bromide | 0.01 g |
| Sodium chloride | 1.5 g |
| Triethanolamine | 8.0 g |
| Potassium carbonate | 30 g |
| N-Ethyl-N-(β-methanesulfonamido-ethyl)-3-methyl-4-aminoaniline sulfate | 4.5 g |
| 4,4'-Diaminostilbene fluorescent whitening agent (Whitex 4, made by Sumitomo Chemical Company, Ltd.) | 2.0 g |
| Water to make | 1,000 cc |
| Adjusted with KOH to pH of 10.25 | |
| Composition of blixing solution: (35° C., 45 seconds) | |
| Ammonium thiosulfate (54 wt %) | 150 ml |

-continued

TABLE 4-continued

| | |
|---|---|
| $Na_2So_3$ | 15 g |
| $NH_4[Fe(III)(EDTA)]$ | 55 g |
| EDTA.2Na | 4 g |
| Glacial acetic acid | 8.61 g |
| Water to make the whole amount (pH 5.4) | 1,000 ml |
| Composition of rinsing solution: (35° C., 90 seconds) | |
| $EDTA.2Na.2H_2O$ | 0.4 g |
| Water to make the whole amount (pH 7.0) | 1,000 ml |

EXAMPLE 3

The results obtained by applying the emulsion of the present invention to multilayer light-sensitive materials are described below.

Light-sensitive layers of the following first to ninth layers were coated onto a paper support having been laminated with polyethylene on both sides to prepare color light-sensitive materials. The polyethylene on the side on which the first layer was coated contained trace amounts of titanium dioxide and ultramarine.

Construction of the light-sensitive layer:

Numerical values corresponding to each component indicate a coating amount expressed by $g/m^2$ unit and silver halide and colloidal silver indicate a coating amount calculated as silver.

| | |
|---|---|
| First layer (layer containing coloring agent) | |
| Black colloidal silver dispersion | 0.07 |
| Gelatin | 0.48 |
| Second layer (intermediate layer) | |
| Gelatin | 0 90 |
| Di-t-octylhydroquinone | 0.05 |
| Solvent (DBP) | 0.10 |
| Third layer (blue-sensitive layer) | |
| Silver chlorobromide emulsion (silver bromide, 80 mol %) silver | 0.30 |
| yellow coupler (*1) | 0.70 |
| Solvent (TNP) | 0.15 |
| Gelatin | 1.20 |
| Fourth layer (intermediate layer) | |
| Gelatin | 0.90 |
| Di-t-octylhydroquinone | 0.05 |
| Solvent (DBP) | 0.10 |
| Fifth layer (green-sensitive layer) | |
| Silver chlorobromide emulsion (silver bromide, 70 mol %) silver | 0.45 |
| Magenta coupler (*2) | 0.35 |

-continued

| | |
|---|---|
| Solvent (TOP) | 0.44 |
| Antifading agent (*3/*4) | 0.05/0.10 |
| Gelatin | 1.00 |
| Sixth layer (UV absorbing intermediate layer) | |
| UV absorbent (*5/*6/*7) | 0.06/0.25/0.25 |
| Solvent (TNP) | 0.20 |
| Seventh layer (red-sensitive layer) | |
| Emulsion Em-F of Example 2 | 0.20 |
| Cyan coupler (*8/*9) | 0.2/0.2 |
| Coupler solvent (TNP/DBP) | 0.10/0.20 |
| Gelatin | 0.9 |

-continued

| | |
|---|---|
| Eighth layer (UV absorbing intermediate layer) | |
| UV absorbent (*5/*6/*7) | 0.06/0.25/0.25 |
| Solvent (DBP) | 0.20 |
| Gelatin | 0.15 |
| Ninth layer (protective layer) | |
| Gelatin | 1.5 |

In the above, DBP, TOP and TNP represent dibutyl phthalte, tri-N-octyl phosphate) and tri(n-nonyl phosphate), respectively. Other compounds used are as follows:

(*1)

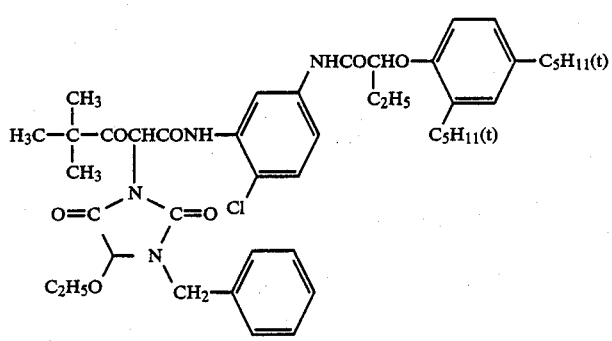

(*2)

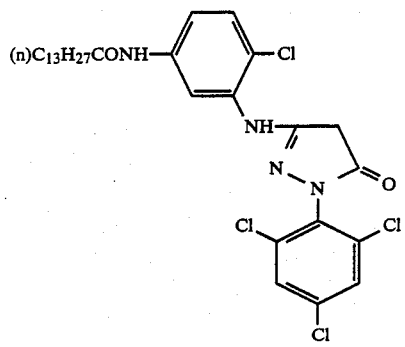

(*3)

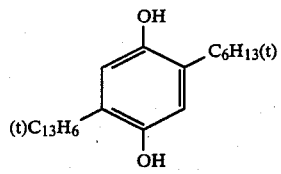

(*4)

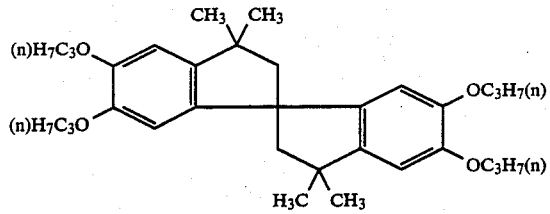

(*5)

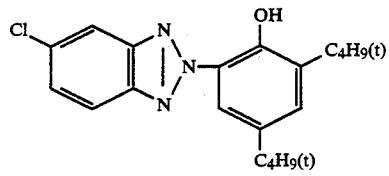

-continued (*6)

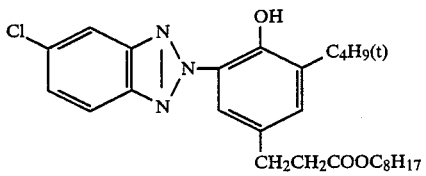

(*7)

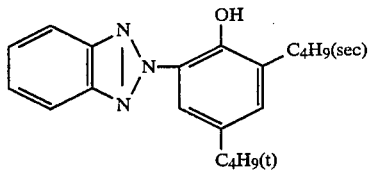

(*8)

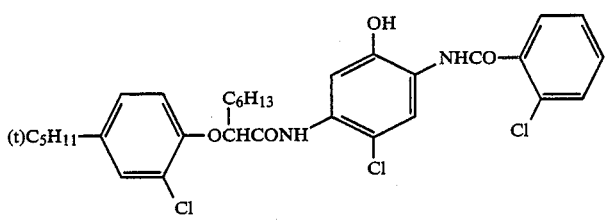

(*9)

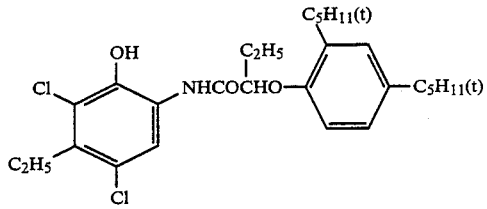

As spectral sensitizers for the respective emulsion layers, the following dyes were used.

Blue-sensitive emulsion layer:

4-{5-Chloro-2-[5-chloro-3-(4-sulfonatobutyl)-benzothiazolin-2-yldenemethyl]-3-benzothiazolio}-butanesulfonate triethylammonium salt ($2\times10^{-4}$ mol/l mol of silver halide)

Green-sensitive emulsion layer:

3,3'-Di-(γ-sulfopropyl)-5,5'-diphenyl-9-ethyloxacarbocyanine sodium salt ($2.5\times10^{-4}$ mol/l mol of silver halide)

Red-sensitive emulsion layer:

3,3'-Di-(γ-sulfopropyl)-9-methylthiadicarbocyanine sodium salt ($2.5\times10^{-4}$ mol/l mol of silver halide)

As antiirradiation dyes for the respective emulsion layers, the following dyes were used.

Green-sensitive emulsion layer:

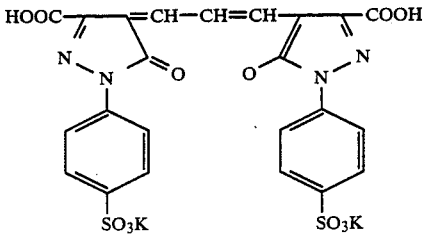

Red-sensitive emulsion layer:

-continued

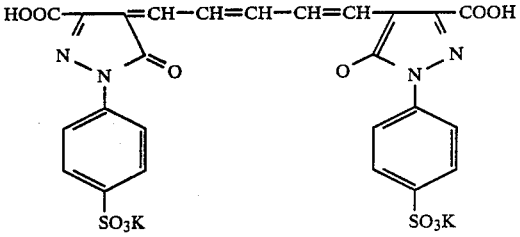

This light-sensitive material was made Sample No. 301.

The emulsion Em-F in the seventh layer was replaced by the emulsion Em-g of Example 2 to make Sample No. 302.

After these samples were exposed to a gradation light for sensitometery and a light passed through a chart for measurement of sharpness with an enlarging machine (made by Fuji Photo Film Co., Ltd., Fuji Color Head 609), development processing was performed by the processing steps described below.

| Processing Step | Temperature | Time |
|---|---|---|
| Developer | 33° C. | 3.5 minutes |
| Blixing solution | 33° C. | 1.5 minutes |
| Rinsing | 28–35° C. | 3.0 minutes |

Developer

| | |
|---|---|
| 3Na nitrilotriacetate | 2.0 g |
| Benzyl alcohol | 15 ml |
| Diethylene glycol | 10 ml |
| $Na_2SO_3$ | 2.0 g |
| KBr | 0.5 g |

-continued

| | |
|---|---|
| Hydroxylamine sulfate | 3.0 g |
| 4-Amino-3-methyl-N-ethyl-N-[β-(methanesulfonamido)ethyl]-p-phenylenediamine sulfate | 5.0 g |
| $Na_2CO_3$ (monohydrate) | 30 g |
| Water to make 1 liter (pH 10.1) | |
| Blixing solution | |
| Ammonium thiosulfate (70 wt %) | 150 ml |
| $Na_2SO_3$ | 15 g |
| $NH_4$[Fe(EDTA)] | 55 g |
| EDTA.2Na | 4 g |
| Water to make 1 liter (pH 6.9) | |

The results of sensitometeric and sharpness tests are shown in Table 5.

The sensitometry was expressed, making the sensitivity of Sample No. 301 "0", by relative relation of a logarithm of exposure amount thereto, wherein + represents a direction of higher sensitivity. Further sharpness was expressed with a difference in density, by determining that a density difference of a shallow line which width should be reproduced by 0.2 mm in a density difference of 1.0 is reduced to a particular value. The larger the density difference, the better the sharpness.

TABLE 5

| Sample No. | 301 | 302 |
|---|---|---|
| Emulsion | Em-F (This Invention) | Em-G (Comparative Example) |
| Sensitivity (red-sensitive layer) | 0 | −0.25 |
| Sharpness (red-sensitive layer) | 0.90 | 0.82 |

EXAMPLE 4

A comparative emulsion was prepared in accordance with U.S. Pat. No. 4,414,306. To 1.5 l of 0.168 M potassium bromide solution containing 1.5% gelatin at 55° C. were added 2.0 M potassium bromide solution and 2.0 M silver nitrate solution over 12 minutes by double jet, while vigorously stirring, during which the silver potential was maintained at −120 mV to saturated caromel electrodes. In this case, 9.1% of the whole silver nitrate was consumed. Thereafter, the silver nitrate solution was added to make the silver potential −40 mV. Then, 0.5 l of 1.88 M potassium chloride solution (0.01 M potassium bromide) was added to the system. 1.72 M potassium bromide solution (1.24 M potassium chloride) was added over 2 hours, simultaneously with 2.0 M silver nitrate solution, at an equal constant rate. In total, 1 mol of silver nitrate was used. After completion of the precipitates, the system was washed. This emulsion was made Em-(H).

To 1.5 l of 0.168 M potassium bromide solution containing 1.5% gelatin at 55° C. were added 2.0 M potassium bromide solution and 2.0 M silver nitrate solution over 12 minutes by double jet, while vigorously stirring, during which the silver potential was maintained at −120 mV to saturated caromel electrodes. In this case, 9.1% of the whole silver nitrate was consumed. Thereafter, the silver nitrate solution was added to make the silver potential −40 mV. While maintaining the silver potential constant, 2.4 M potassium bromide solution was added over 50 minutes, simultaneously with 2.0 M silver nitrate solution. In this case, 73.7% of the whole silver nitrate used was consumed. Thereafter 4.0 M potassium chloride solution and 2.0 M silver nitrate solution were simultaneously added over 10 minutes, at an equal constant rate. In total, 1 mol of silver nitrate was used. After completion of the precipitates, the system was washed. This emulsion was made Em-I.

Grain size and halogen composition of Em-H and Em-I are shown in Table 6.

TABLE 6

(Grain Size and Halogen Composition)

| Em No. | Grain Diameter Corresponding to Circle (μm) | Grain Thickness (μm) | Aspect Ratio | Coefficient of Variation of Diameter Corresponding to Circle (%) | Cl Content (mol %) |
|---|---|---|---|---|---|
| Em-H (Comparison) | 1.4 | 0.20 | 7.0 | 62 | 14 |
| Em-I (Invention) | 1.4 | 0.21 | 6.7 | 25 | 14 |

As is clear from Table 6, the emulsion Em-I of the present invention showed an extremely small coefficient of variation of diameter corresponding to circle, as compared to Em-H. That is, the emulsion of the present invention was excellent in monodispersing properties.

Observation of Em-I and Em-H with a low temperature transmitting electron microscope at a voltage of 200 kV reveals that Em-H was composed of a silver bromide central grain region and an annular grain region composed of silver chloride surrounding the circumference of the central grain region. On the other hand, such a region was not observed with the emulsion Em-I of the present invention. That is, it is shown that silver chloride deposited on the tabular direction on the silver bromide tabular grains which became the base.

A coating aid and a hardener were added to Em-H and Em-I and the resulting solution was coated onto a cellulose triacetate film base to have a silver coverage of 2 g/m$^2$. The coated emulsion was exposed to a tungsten lump (color temperature, 2854 K) for a second through a continuous wedge. The exposed coated emulsion was developed with the following surface developer (MAA-1) at 20° C. for 2, 4 and 8 minutes.

| MAA-1 | |
|---|---|
| Methol (p-methylaminophenol sulfate) | 2.5 g |
| d-Ascorbic acid | 10.0 g |
| potassium bromide | 1.0 g |
| Nabox | 35.0 g |
| Water to make | 1,000 ml |

The sensitivity of the obtained emulsion was expressed by a relative value of a reciprocal number of exposure amount required to show an optical density of fog +0.5.

The results obtained are shown in Table 7.

TABLE 7

(Comparison in Development Progress)

| Em-No. | Developing Time 2 min. | 4 min. | 8 min. |
|---|---|---|---|
| Em-H (Comparison) | 20 | 60 | 100 (standard) |
| Em-I (Invention) | 40 | 80 | 110 |

As is clear from Table 7, the emulsion of the present invention was excellent in development progress.

EXAMPLE 5

Em-B obtained in Example 1 of the present invention was likewise used in place of the silver halide emulsion in the blue-sensitive layer of Sample (1) in Example 1 of JP-A-62-215272. Good photographic properties (sensitivity, fog and pressure properties) were obtained.

EXAMPLE 6

Good photographic properties (sensitivity, fog and pressure properties) were obtained, using Em-B obtained in Example 1 of the present invention in each emulsion layer of Sample 101 in Example 1 of JP-A-62-136650.

While the invention has been described in detail and with reference to specific embodiments thereof, it is apparent to one skilled in the art that various changes and modifications can be made therein without departing from the spirit and the scope of the present invention.

What is claimed is:

1. A silver halide photographic emulsion comprising a hydrophilic colloid having dispersed therein tabular silver halide grains having an aspect ratio of at least 2, said grains comprising a matrix comprising at least 50 mol% silver bromide ions based on silver ions, and a high silver chloride layer on said matrix, said high silver chloride layer comprising at least 50 mol% chloride ions based on silver ions and forming a substantially uniform plane on said matrix, wherein at least 50 mol% of the high silver chloride layer is present on two basal plane surfaces of said matrix.

2. The silver halide photographic emulsion of claim 1, wherein at least 80 mol% or more of the high silver chloride layer is present on two basal plane surfaces of said matrix.

3. The silver halide photographic emulsion of claim 1, wherein at least 90 mol% of the high silver chloride layer is present on two basal plane surfaces of said matrix.

4. The silver halide photographic emulsion of claim 1, wherein said matrix comprises 70 mol% or more bromide ions and 30 mol% or less iodide ions.

5. The silver halide photographic emulsion of claim 1, wherein said high silver chloride layer comprises 60 mol% or more chloride ions.

6. The silver halide photographic emulsion of claim 5, wherein said high silver chloride layer comprises 70 mol% or more chloride ions.

7. The silver halide photographic emulsion of claim 1, wherein said high silver chloride layer comprises at least 5 mol% of the grains calculated as silver based on said matrix.

8. The silver halide photographic emulsion of claim 7, wherein said high silver chloride layer is present in an amount of from 10 mol% or more.

9. The silver halide photographic emulsion of claim 8, wherein said high silver chloride layer is present in an amount of from 20 mol% or more.

10. The silver halide photographic emulsion of claim 1, wherein said silver halide grains further comprise a localized high silver bromide layer on the high silver chloride layer.

11. The silver halide photographic emulsion of claim 10, wherein said localized layer is present in an amount of from 0.01 to 10 mol% based on the total silver halide amount.

12. The silver halide photographic emulsion of claim 10, wherein the amount of silver bromide contained in the localized layer is greater than the mean silver bromide content in the high silver chloride layer.

13. The silver halide photographic emulsion of claim 12, wherein 50 mol% or more of the localized layer is silver bromide.

14. The silver halide photographic emulsion of claim 1, wherein the mean diameter of the tabular silver halide grains is from 0.5 to 3.0 μm, and the mean thickness of the grains is below 0.5 μm.

15. The silver halide photographic emulsion of claim 1, wherein said emulsion comprises said tabular silver halide grains having an aspect ratio of at least 2 in an amount of 50% or more based on the projected area of the whole grains.

16. The silver halide photographic emulsion of claim 15, wherein said tabular silver halide grains comprise 90% or more of the emulsion.

17. The silver halide photographic emulsion of claim 1, wherein said tabular silver halide grains contain at least 5 grains, which have curved basal plane surfaces among 100 grains.

18. The silver halide photographic emulsion of claim 17, wherein said tabular silver halide grains contain at least 10 grains, which have curved basal plane surfaces among 100 grains.

19. The silver halide photographic emulsion of claim 1, wherein the aspect ratio of said tabular grains is at least 3.

20. The silver halide photographic emulsion of claim 1, wherein the aspect ratio of said tabular grains is at least 5.

* * * * *